US008534663B2

(12) United States Patent
Kuo

(10) Patent No.: US 8,534,663 B2
(45) Date of Patent: Sep. 17, 2013

(54) AUTOMATIC DOCUMENT FEEDER

(75) Inventor: Ping-Hung Kuo, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 13/416,965

(22) Filed: Mar. 9, 2012

(65) Prior Publication Data

US 2013/0140759 A1 Jun. 6, 2013

(30) Foreign Application Priority Data

Dec. 2, 2011 (TW) ..... 100144334 A

(51) Int. Cl.
*B65H 5/00* (2006.01)

(52) U.S. Cl.
USPC ..... 271/10.1; 271/114; 271/116; 271/10.12

(58) Field of Classification Search
USPC ..... 271/10.11, 10.12, 10.13, 114, 116
See application file for complete search history.

(56) References Cited

U.S. PATENT DOCUMENTS

| | | | | |
|---|---|---|---|---|
| 5,116,038 | A * | 5/1992 | Kim | 271/10.11 |
| 5,435,539 | A * | 7/1995 | Namiki | 271/114 |
| 6,139,006 | A * | 10/2000 | Asada | 271/121 |
| 6,913,257 | B2 * | 7/2005 | Takaki et al. | 271/125 |
| 7,484,723 | B2 * | 2/2009 | Kuo et al. | 271/10.09 |
| 7,594,650 | B2 * | 9/2009 | Chung et al. | 271/116 |
| 2011/0316222 | A1 * | 12/2011 | Takiguchi et al. | 271/114 |

* cited by examiner

*Primary Examiner* — Kaitlin Joerger
(74) *Attorney, Agent, or Firm* — Kirton McConkie; Evan R. Witt

(57) ABSTRACT

An automatic document feeder includes a paper pick-up device, a transfer roller assembly, and a duplex feeding channel. The transfer roller assembly includes a shaft, a first roller, a second roller, a first idler, a second idler, and a power-coupling device. When the power-coupling device is connected with the shaft and the first roller for transmitting a paper, the first roller is driven to be rotated by the shaft. When the front edge of the paper is moved to the second roller, the first roller is driven to be rotated at a higher speed by the paper. Consequently, a power connection between the first roller and the shaft is released by the power-coupling device. Then, the first roller reaches a static status in order to correct the skew phenomenon of a next paper.

9 Claims, 9 Drawing Sheets

AUTOMATIC DOCUMENT FEEDER

FIELD OF THE INVENTION

The present invention relates to an automatic document feeder, and more particularly to an automatic document feeder with a function of correcting a skewed paper.

BACKGROUND OF THE INVENTION

For facilitating the user to print or scan a large number of papers, an office machine (e.g. a printer, a scanner or a multifunction peripheral) is usually equipped with an automatic document feeder. By means of the automatic document feeder, a stack of papers can be successively fed into the office machine without the need of using the man power. Consequently, the papers can be printed, scanned or processed at a fast speed and in a labor-saving manner.

However, if the paper is not exactly placed on the inlet tray of the automatic document feeder in the beginning, the paper is aslant fed into the internal portion of the office machine. Under this circumstance, the printing or scanning quality of the office machine is deteriorated, and the paper is readily jammed in the automatic document feeder. The jammed paper becomes hindrance from performing the subsequent tasks. For preventing the skewed paper from being fed into the office machine through the automatic document feeder and obviating erroneous operations of the office machine, an automatic document feeder with a function of correcting a skewed paper was disclosed. Please refer to FIG. 1, which schematically illustrates a conventional automatic document feeder.

As shown in FIG. 1, the conventional automatic document feeder 10 comprises a paper pick-up device 11 and a transfer roller assembly 12. The paper pick-up device 11 comprises a pick-up roller 111 and a separation roller 112. The pick-up roller 111 is used for transporting a paper S into the automatic document feeder 10. The separation roller 112 is located downstream of the pick-up roller 111 for providing a friction force to separate the paper S, thereby preventing a plurality of papers S from being simultaneously transmitted into the automatic document feeder 10.

Please refer to FIG. 1 again. The transfer roller assembly 12 is located downstream of the paper pick-up device 11. In addition, the transfer roller assembly 12 comprises a shaft 121 and a roller 122. The shaft 121 is connected to a power source (not shown). The roller 122 is sheathed around and connected with the shaft 121. Consequently, the roller 122 is synchronously rotated with the shaft 121. Whereas, in a case that the shaft 121 is in a static status, the roller 122 is also in the static status.

When the pick-up roller 111 of the paper pick-up device 11 is rotated and contacted with the paper S, the paper S is transmitted to the separation roller 112 to be separated. The subsequent actions of the conventional automatic document feeder 10 will be illustrated with reference to FIG. 2. FIG. 2 schematically illustrates the actions of the conventional automatic document feeder.

As shown in FIG. 2, when the paper S transmitted through the separation roller 112 is moved to the transfer roller assembly 12, the shaft 121 and the roller 122 of the transfer roller assembly 12 are in the static status in order to hinder the paper S from being continuously advanced. Meanwhile, the paper S is continuously transmitted into the automatic document feeder 10 by the paper pick-up device 11, which is located upstream of the transfer roller assembly 12. Consequently, the front edge of the paper S is moved to the static roller 122 and slightly upturned. After the front edge of the paper S is completely moved to the roller 122, the function of correcting the skewed paper S is achieved.

After a preset time period, the front edge of the paper S is completely moved to the roller 122, and the function of correcting the skewed paper S is achieved. Then, the shaft 121 of the transfer roller assembly 12 acquires the electric power again to drive rotation of the roller 122. Consequently, the paper S is allowed to be transmitted through the transfer roller assembly 12.

Although the conventional automatic document feeder 10 is effective to correct the skewed paper S, there are still some drawbacks. For example, for correcting the skewed paper S by the conventional automatic document feeder 10, the rotation of the shaft 121 is an important factor for determining whether the paper S is continuously advanced or not. As previously described, the paper S is hindered by the static shaft 121 until the front edge of the paper S is completely moved to the roller 122. Once the front edge of the paper S is completely moved to the roller 122, the shaft 121 starts to rotate again. However, it takes an additional time period to accelerate the shaft 121 from the static status to a normal speed. Since each of the papers S to be transmitted needs the accelerating process, if a large number of papers are frequently processed by the conventional automatic document feeder 10, the paper-feeding efficiency is impaired and the processing time is largely prolonged

SUMMARY OF THE INVENTION

The present invention provides an automatic document feeder with a high paper-feeding efficiency.

In accordance with an aspect of the present invention, there is provided an automatic document feeder. The automatic document feeder includes a paper pick-up device, a shaft, a first roller, a second roller, a first idler, and a power-coupling device. The paper pick-up device is used for transmitting a paper into the automatic document feeder. The shaft is located downstream of the paper pick-up device and rotated at a first speed. The first roller is sheathed around the shaft. The second roller is disposed on the shaft for transmitting the paper. A diameter of the second roller is greater than a diameter of the first roller. The second roller is driven to be rotated at a second speed by the shaft. The first idler is located upstream of the shaft for performing a skew correction on the paper. The first idler is driven to be rotated by the first roller. The power-coupling device is disposed on the shaft, and located at a side of the first roller. When the power-coupling device is connected with the shaft and the first roller, the first roller is driven to be rotated at a third speed by the shaft, and the first idler is driven to be rotated by the first roller to start to transmit the paper. When the paper is transmitted through the first roller and the second roller simultaneously, the first roller is driven to be rotated at the second speed by the paper, so that a power connection between the shaft and the first roller is released by the power-coupling device. The second speed is higher than the third speed. After the paper is completely departed from the first roller and during the power connection between the shaft and first roller is established by the power-coupling device again, the first roller and the first idler reach a static status.

In an embodiment, the power-coupling device is a clutch spring.

In an embodiment, the paper pick-up device includes a pick-up roller and a separation roller.

In an embodiment, the automatic document feeder further includes a second idler. The second idler is just disposed over the second roller, wherein the second idler is driven to be rotated by the second roller.

In an embodiment, the automatic document feeder further includes a duplex feeding channel for duplex feeding the paper, wherein the shaft is disposed in the duplex feeding channel.

In an embodiment, the power-coupling device has a protrusion structure, and the first roller has a concave structure, wherein the protrusion structure is disposed in the concave structure.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
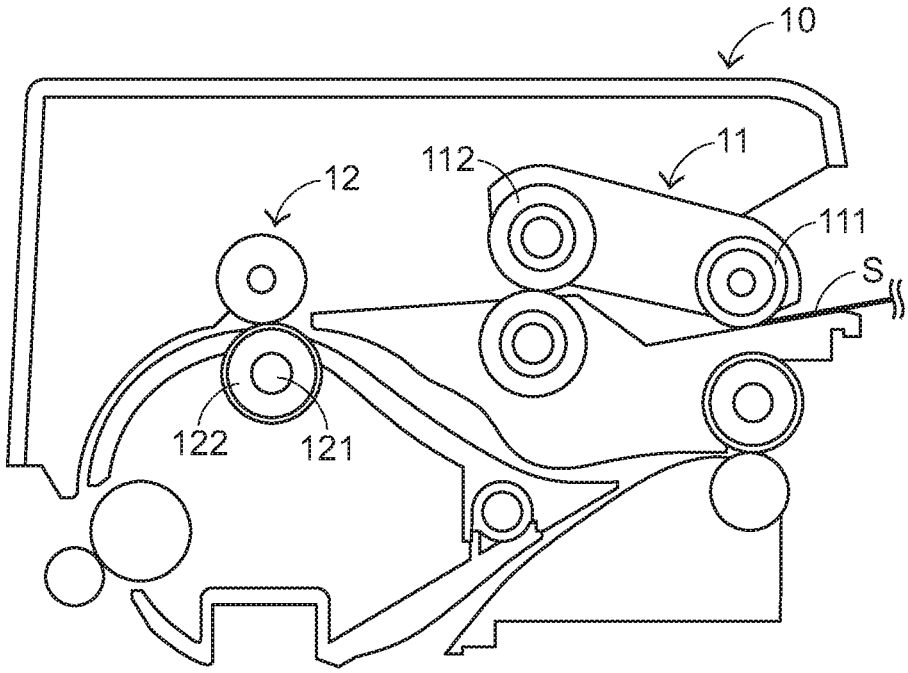
FIG.1 PRIOR ART
FIG. 1 schematically illustrates a conventional automatic document feeder.
Figure 2:
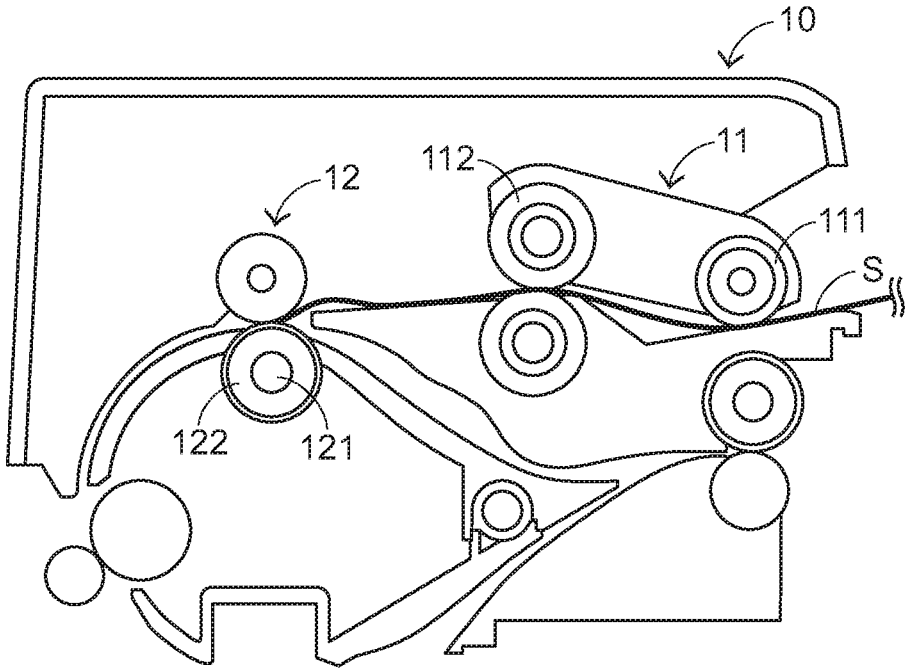
FIG.2 PRIOR ART
FIG. 2 schematically illustrates the actions of the conventional automatic document feeder.
Figure 3:
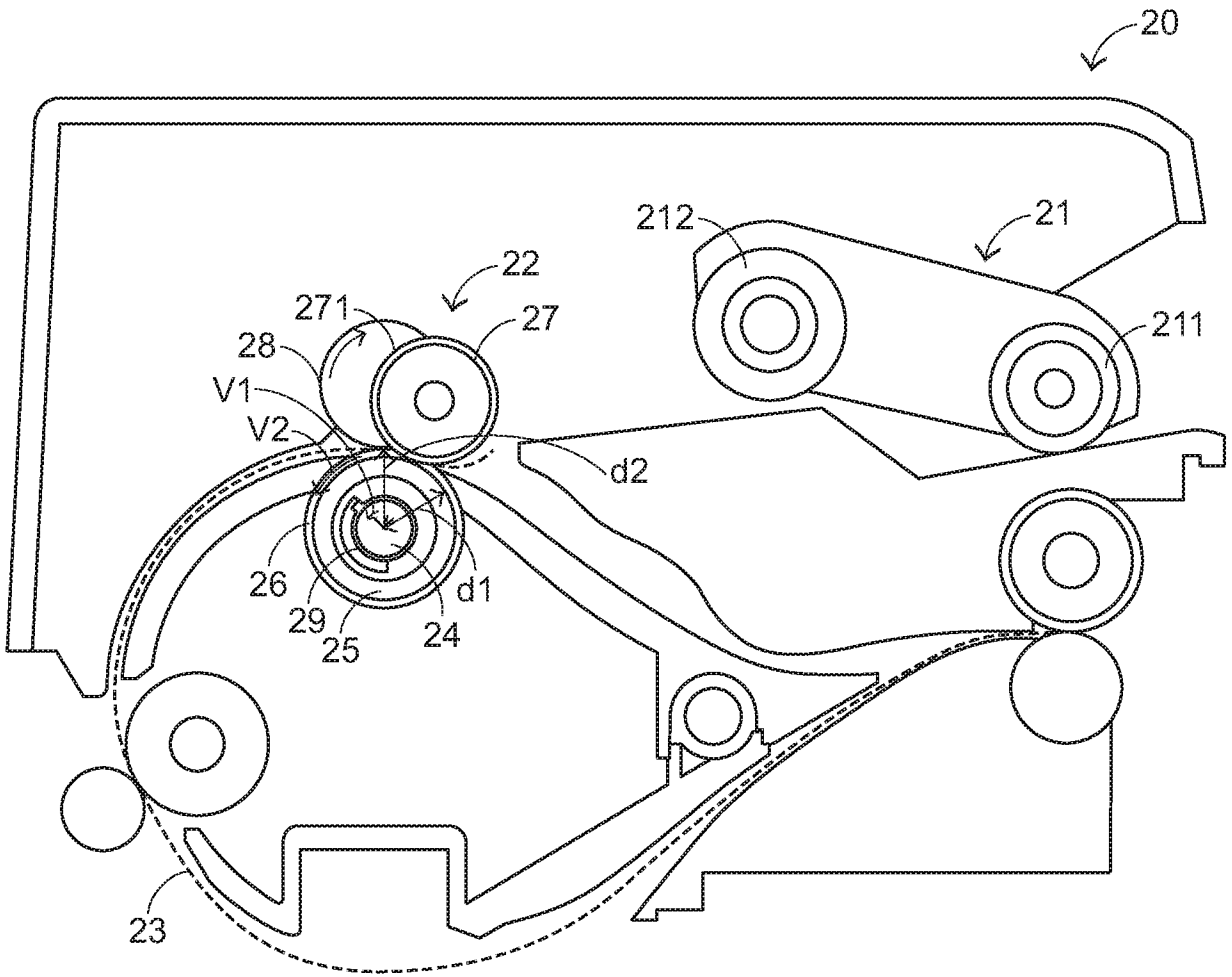
FIG. 3 schematically illustrates an automatic document feeder according to an embodiment of the present invention.

FIG. 3 schematically illustrates an automatic document feeder according to an embodiment of the present invention. As shown in FIG. 3, the automatic document feeder 20 comprises a paper pick-up device 21, a transfer roller assembly 22, a duplex feeding channel 23, and a power source (not shown). The paper pick-up device 21 is located at a paper entrance. The duplex feeding channel 23 is located downstream of the paper pick-up device 21. The transfer roller assembly 22 is disposed in the duplex feeding channel 23 for correcting a skewed paper during a duplex feeding operation is performed.

In this embodiment, the automatic document feeder 20 at least has a duplex feeding function. For complying with the small-sized requirement of the automatic document feeder 20, a front-side feeding path and a back-side feeding path of the automatic document feeder 20 are integrated, so that a portion of a common feeding channel is defined by the front-side feeding path and the back-side feeding path collaboratively. In such way, the volume required for installing the feeding channel is reduced. In this context, the duplex feeding channel 23 is a common feeding channel for transmitting the double sides of the paper during the duplex feeding operation is performed by the automatic document feeder 20. Moreover, the use of the duplex feeding channel 23 is not limited to the implementation of the duplex feeding operation.

Hereinafter, the configurations of the paper pick-up device 21 and the transfer roller assembly 22 will be illustrated in more details. Please refer to FIG. 3 again. The paper pick-up device 21 comprises a pick-up roller 211 and a separation roller 212. The pick-up roller 211 is used for transmitting a paper into the automatic document feeder 20. The separation roller 212 is located downstream of the pick-up roller 211 for providing a friction force to separate the paper, thereby preventing a plurality of papers from being simultaneously transmitted into the automatic document feeder 20.

The transfer roller assembly 22 is located downstream of the paper pick-up device 21. After the paper is transmitted into the automatic document feeder 20, the paper may be transmitted by the transfer roller assembly 22 to be continuously advanced. In this embodiment, the transfer roller assembly 22 comprises a shaft 24, a first roller 25, a second roller 26, a first idler 27, a second idler 28, and a power-coupling device 29. In accordance with the present invention, there is a speed difference between the second roller 26 and the first roller 25 in order to achieve the function of correcting the skewed paper. For resulting in the speed difference, the radius d2 of the second roller 26 is greater than the radius d1 of the first roller 25. That is, the diameter of the second roller 26 is greater than the diameter of the first roller 25

Please refer to FIG. 3 again. The shaft 24 of the transfer roller assembly 22 is located downstream of the paper pick-up device 21, and disposed in the duplex feeding channel 23. The first roller 25 is sheathed around the shaft 24. The second roller 26 and the power-coupling device 29 are disposed on the shaft 24. In addition, the second roller 26 and the power-coupling device 29 are driven to be rotated by the shaft 24.

The first idler 27 is disposed over the first roller 25. The first idler 27 is driven to be rotated by the first roller 25, so that the function of correcting the skewed paper is achieved. The second idler 28 is just disposed over the second roller 26. The second idler 28 is driven to be rotated by the second roller 26. Since the second roller 26 is continuously driven by the shaft 24, the second roller 26 is continuously rotated. Since the second idler 28 is driven by the second roller 26, the second idler 28 is continuously rotated. If the first idler 27 and the second idler 28 are arranged at the same horizontal line, when the paper is transmitted to the transfer roller assembly 22, the paper is contacted with the first roller 25 and the second roller 26 simultaneous. Since the paper is contacted with the second roller 26, the paper can be continuously advanced without the need of performing any skew correction on the paper. Since the first idler 27 is not only disposed over the first roller 25 but also located upstream of the shaft 24, the skewed paper can be well corrected before the paper is transmitted through the transfer roller assembly 22.

The power source of the automatic document feeder 20 is connected with the shaft 24 for driving the shaft 24 to be rotated at a first speed V1. The second roller 26 is driven by the shaft 24 to be rotated at a second speed V2. In this context, the first speed V1 denotes a path length of a particle moving on a shaft surface of the shaft 24 in a unit time; and the second speed V2 denotes a path length of a particle moving on a roller surface of the second roller 26 in a unit time.

Moreover, for enhancing the stability of transmitting the papers, the automatic document feeder 20 of the present invention may have two first rollers 25 and two second rollers 26. In such way, during the paper is transmitted through the first rollers 25 and two second rollers 26, the force is uniformly exerted on the paper to reduce the possibility of causing the skewed paper.

Figure 4:
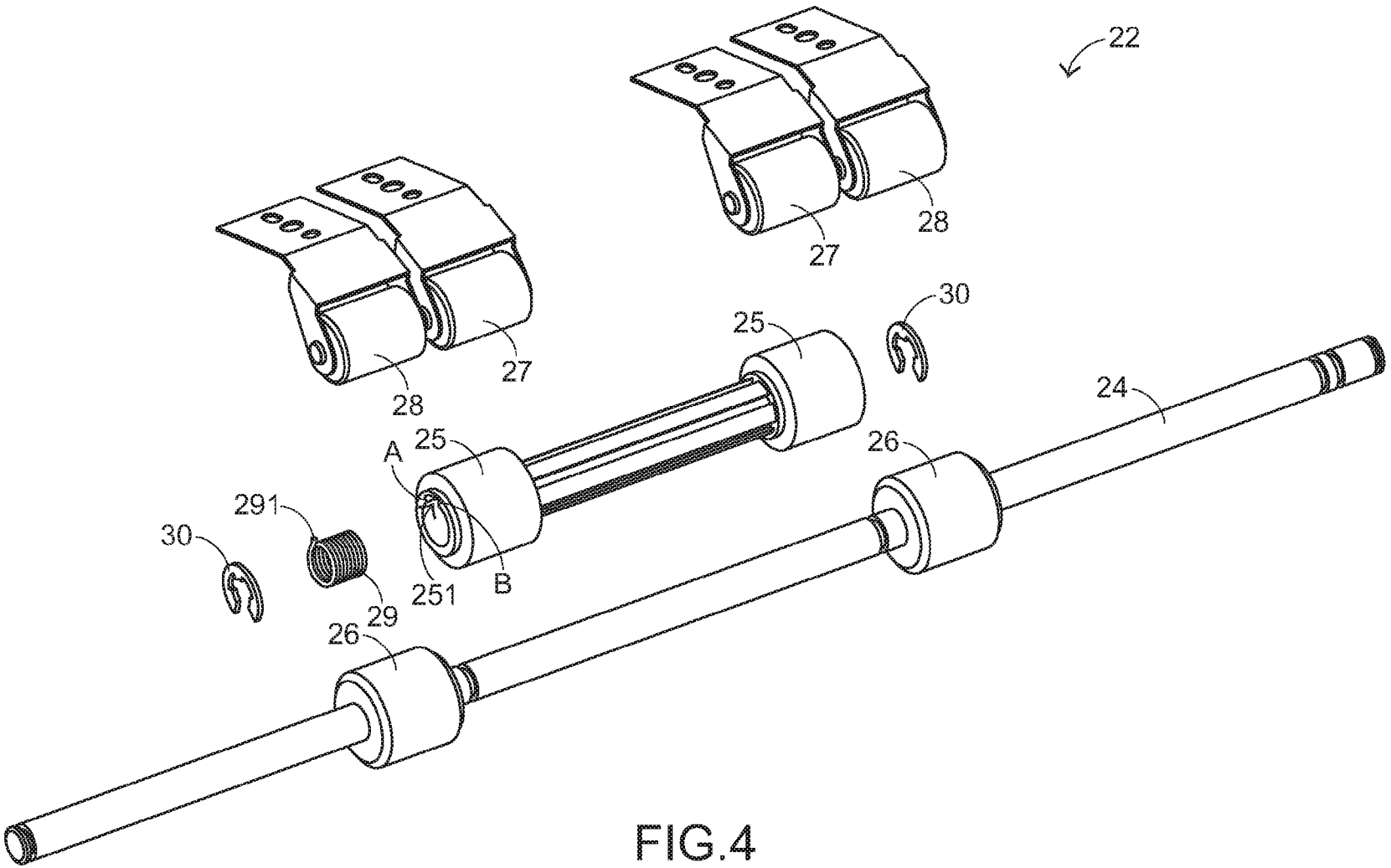
FIG. 4 is a schematic exploded view illustrating the transfer roller assembly of the automatic document feeder according to the first embodiment of the present invention.

Hereinafter, the configurations of the transfer roller assembly 22 will be illustrated with reference to FIG. 4. FIG. 4 is a schematic exploded view illustrating the transfer roller assembly of the automatic document feeder according to the embodiment of the present invention. As shown in FIG. 4, the transfer roller assembly 22 comprises a shaft 24, a first roller 25, a second roller 26, a first idler 27, a second idler 28, and a power-coupling device 29. A protrusion structure 291 is located at an end of the power-coupling device 29. In addition, a concave structure 251 is formed in an inner surface of the first roller 25. The protrusion structure 291 of the power-coupling device 29 is disposed in the concave structure 251 of the first roller 25.

In this embodiment, the power-coupling device 29 is a clutch spring. The power-coupling device 29 is sheathed around the shaft 24, and located at a side of the first roller 25. Especially, the power-coupling device 29 is disposed on the inner surface of the first roller 25. When a first end A of the concave structure 251 is pushed by the protrusion structure 291, the power-coupling device 29 is connected with the shaft 24 and the first roller 25, thereby driving rotation of the first roller 25.

Moreover, for preventing from the horizontal movement of the rotating first roller 25 and reducing the adverse influence on the paper-feeding operation, a C-shaped ring 30 is located beside the first roller 25. The C-shaped ring 30 is sheathed around the shaft 24 for limiting the position of the first roller 25.

Hereinafter, the actions of the components of the transfer roller assembly 22 and the duplex feeding operation of the automatic document feeder 20 will be illustrated with reference to FIGS. 5, 6, 7, 8, 9 and 10. FIGS. 5-10 schematically illustrate the paper-feeding operation of the automatic document feeder according to the embodiment of the present invention.

Figure 5:
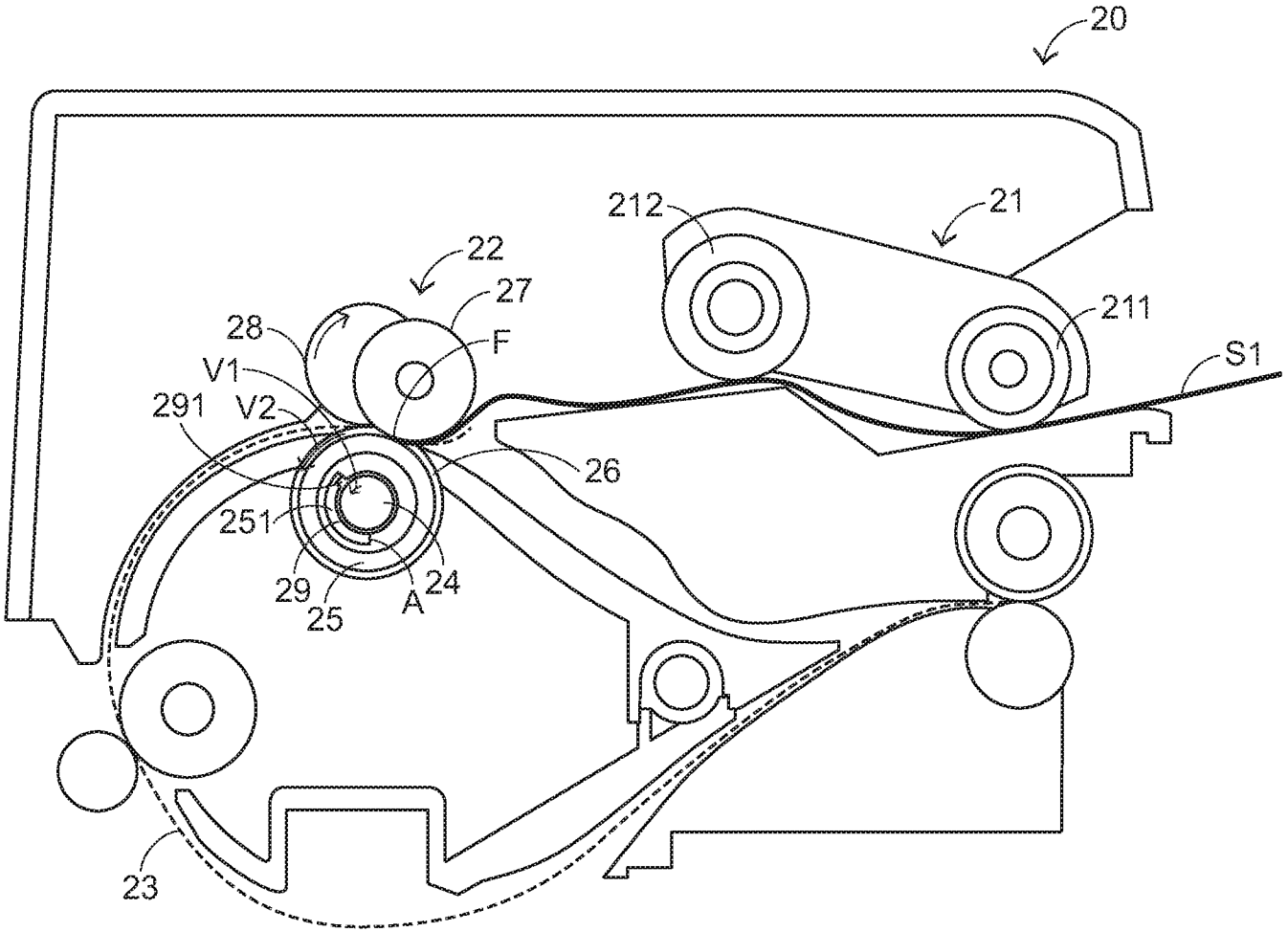
FIGS. 5~10 schematically illustrate the paper-feeding operation of the automatic document feeder according to the embodiment of the present invention.
Figure 6:
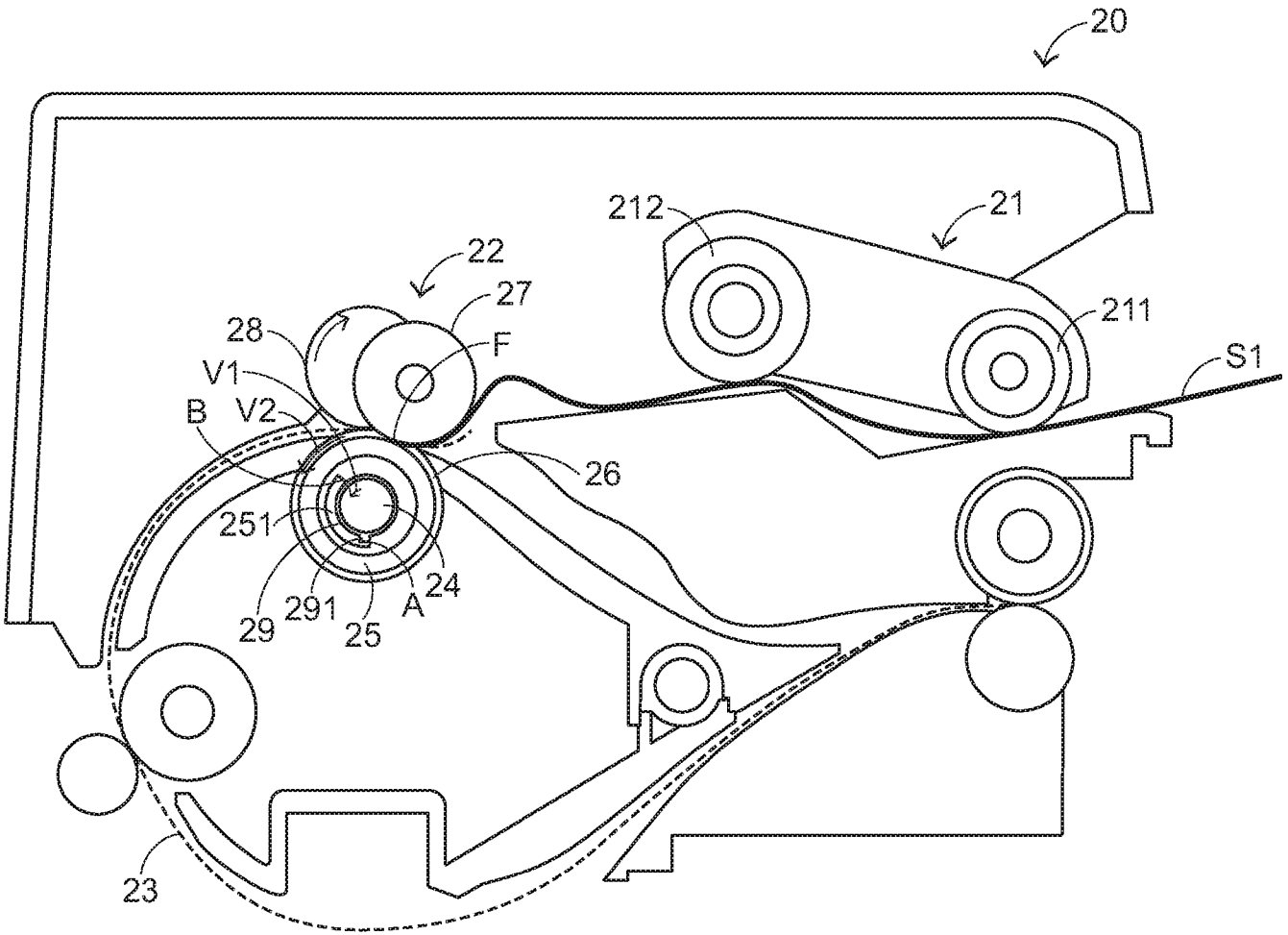

Firstly, as shown in FIG. 5, the pick-up roller 211 is contacted with a paper S1, so that the paper S1 is transmitted into the automatic document feeder 20. The separation roller 212 is located downstream of the pick-up roller 211 for providing a friction force to separate the paper S1, thereby preventing a plurality of papers from being simultaneously fed into the automatic document feeder 20. The paper S1 is introduced into the duplex feeding channel 23 and then moved to the transfer roller assembly 22.

Meanwhile, the shaft 24 is rotated at the first speed V1. In addition, the second roller 26 and the power-coupling device 29 are synchronously rotated with the shaft 24. Since the protrusion structure 291 has not been sustained against the first end A of the concave structure 251, the shaft 24 fails to drive synchronous rotation of the first roller 25 through the power-coupling device 29. Under this circumstance, the first roller 25 is in the static status. In addition, the first idler 27 in contact with the first roller 25 is also in the static status for hindering the paper S1 from being continuously advanced.

Next, the paper S1 is continuously transmitted by the paper pick-up device 21, which is located upstream of the transfer roller assembly 22. Consequently, the front edge F of the paper S1 is moved to the static first roller 25 and the first idler 27, and the front edge F of the paper S1 is slightly upturned. Then, a preset waiting time is required for allowing the front edge F of the paper S1 to be completely moved to the first roller 25.

After the preset waiting time, the front edge F of the paper S1 is completely moved to the first roller 25 (see FIG. 6), and the function of correcting the skewed paper S1 is achieved. Meanwhile, the protrusion structure 291 of the power-coupling device 29 is moved from a second end B of the concave structure 251 toward the first end A of the concave structure 251. Meanwhile, the power-coupling device 29 becomes a connecting medium between the shaft 24 and the first roller 25. Consequently, the power-coupling device 29 is ready to drive rotation of the first roller 25.

Figure 7:
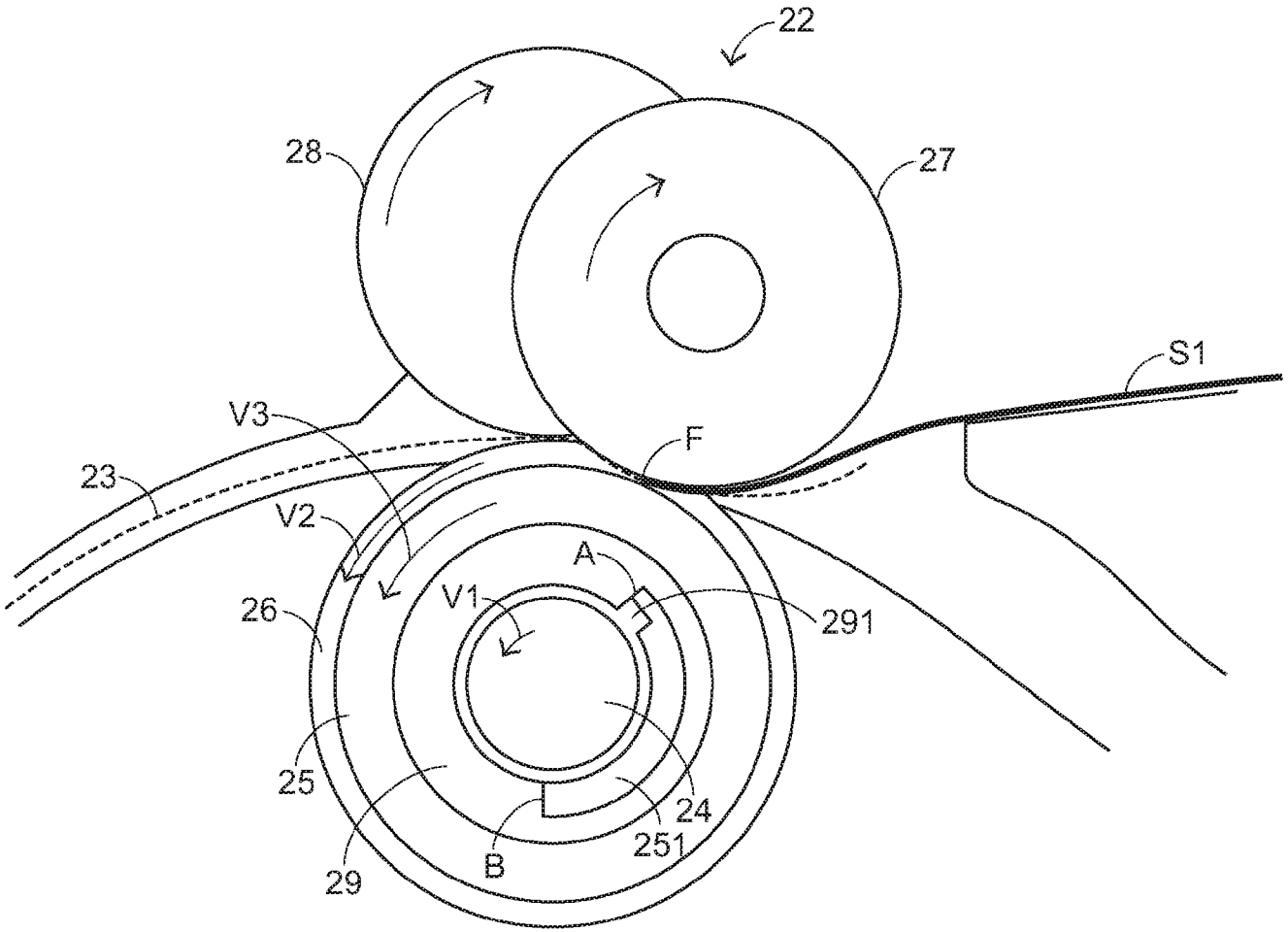

As shown in FIG. 7, the first end A of the concave structure 251 is pushed by the protrusion structure 291, so that the first roller 25 is driven to be rotated by the shaft 24 and the first roller 25 is rotated at a third speed V3. Meanwhile, the paper S1 originally hindered by the first roller 25 and the first idler 27 is transmitted by the first roller 25 (at the third speed V3) to the second roller 26.

Since the diameter of the second roller 26 is greater than the diameter of the first roller 25 and the motive power is supplied to the shaft 24 by the same power source, the second speed V2 is certainly higher than the third speed V3. Similarly, the third speed V3 denotes a path length of a particle moving on a roller surface of the first roller 25 in a unit time.

Figure 8:
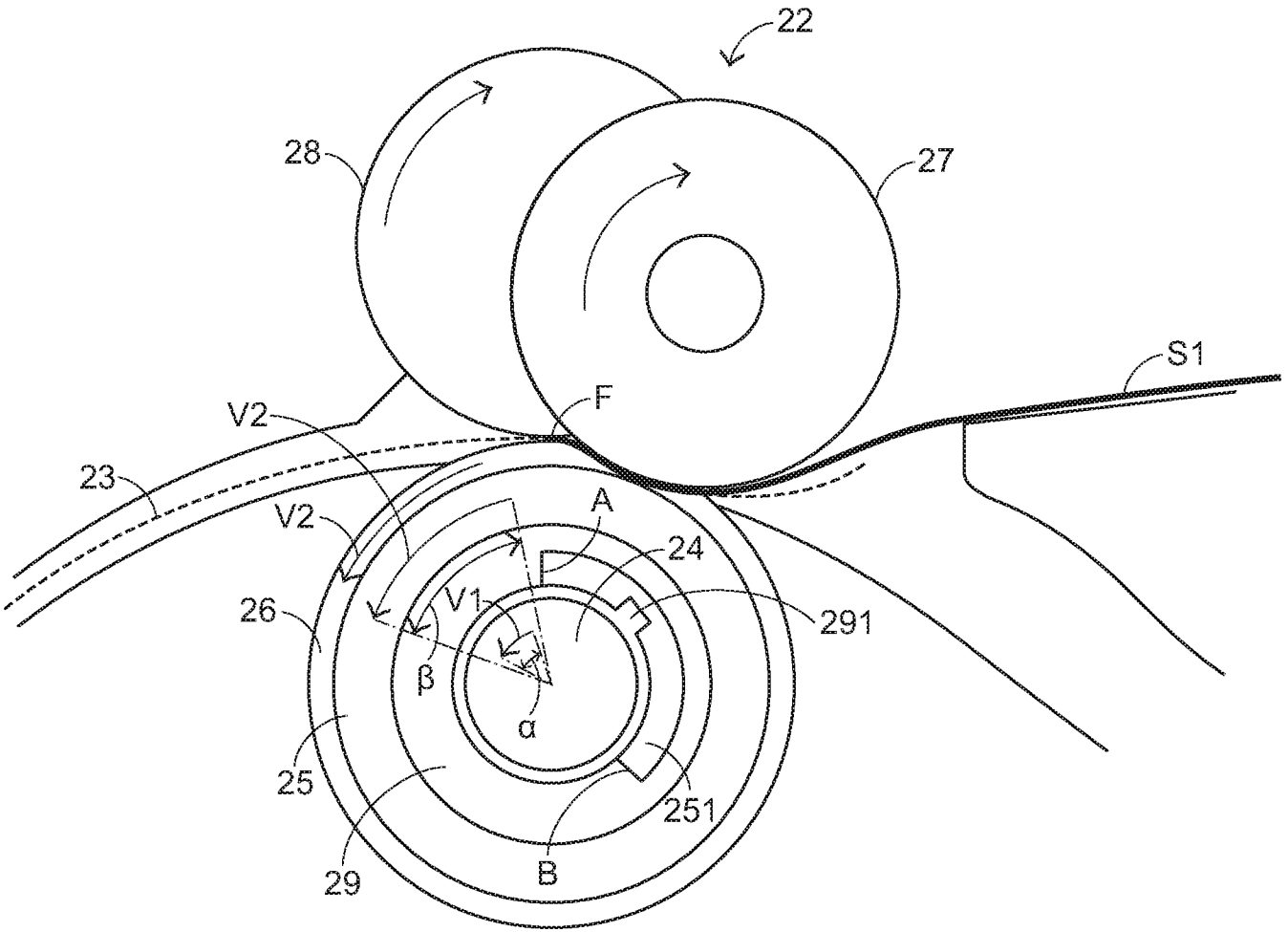

As shown in FIG. 8, the front edge F of the paper S1 is moved to the second roller 26, and the paper S1 has not been completely departed from the first roller 25. Meanwhile, the paper S1 is transmitted by the second roller 26. Meanwhile, the speed of moving the paper S1 is switched from the third speed V3 to the second speed V2. In addition, the first roller 25 is driven to be rotated at the second speed V2 by the paper S1.

When the first roller 25 is rotated at the second speed V2 higher than third speed V3, the shaft 24 is still rotated at the first speed V1. Since the power-coupling device 29 is disposed on the shaft 24, the power-coupling device 29 is also rotated at the original speed. Meanwhile, the angular variation $\alpha$ of the shaft 24 which is rotated at the first speed V1 is obviously smaller than the angular variation $\beta$ of the first roller 25 which is rotated at the second speed V2. Meanwhile, the protrusion structure 291 is gradually moved from the first end A of the concave structure 251 toward the second end B of the concave structure 251.

After the protrusion structure 291 is moved to the second end B of the concave structure 251, the power-coupling device 29 is synchronously rotated with the first roller 25. Consequently, the power-coupling device 29 is no longer driven by the shaft 24. After the paper S1 is completely departed from the first roller 25, the external force acting on the first roller 25 is eliminated and the first roller 25 loses the motive power, so that the first roller 25 reaches the static status. Under this circumstance, the first idler 27 is also in the static status.

Figure 9:
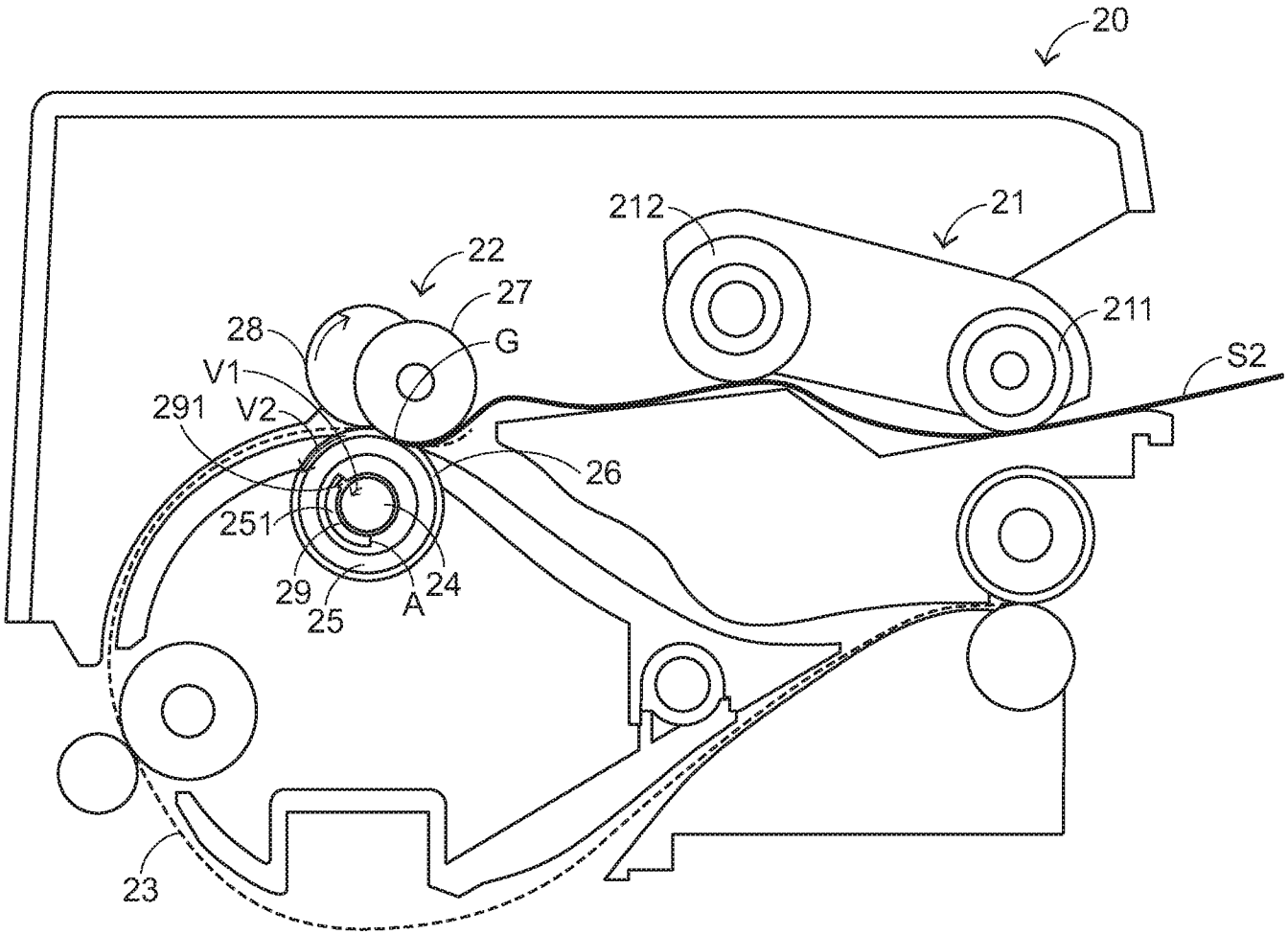
Figure 10:
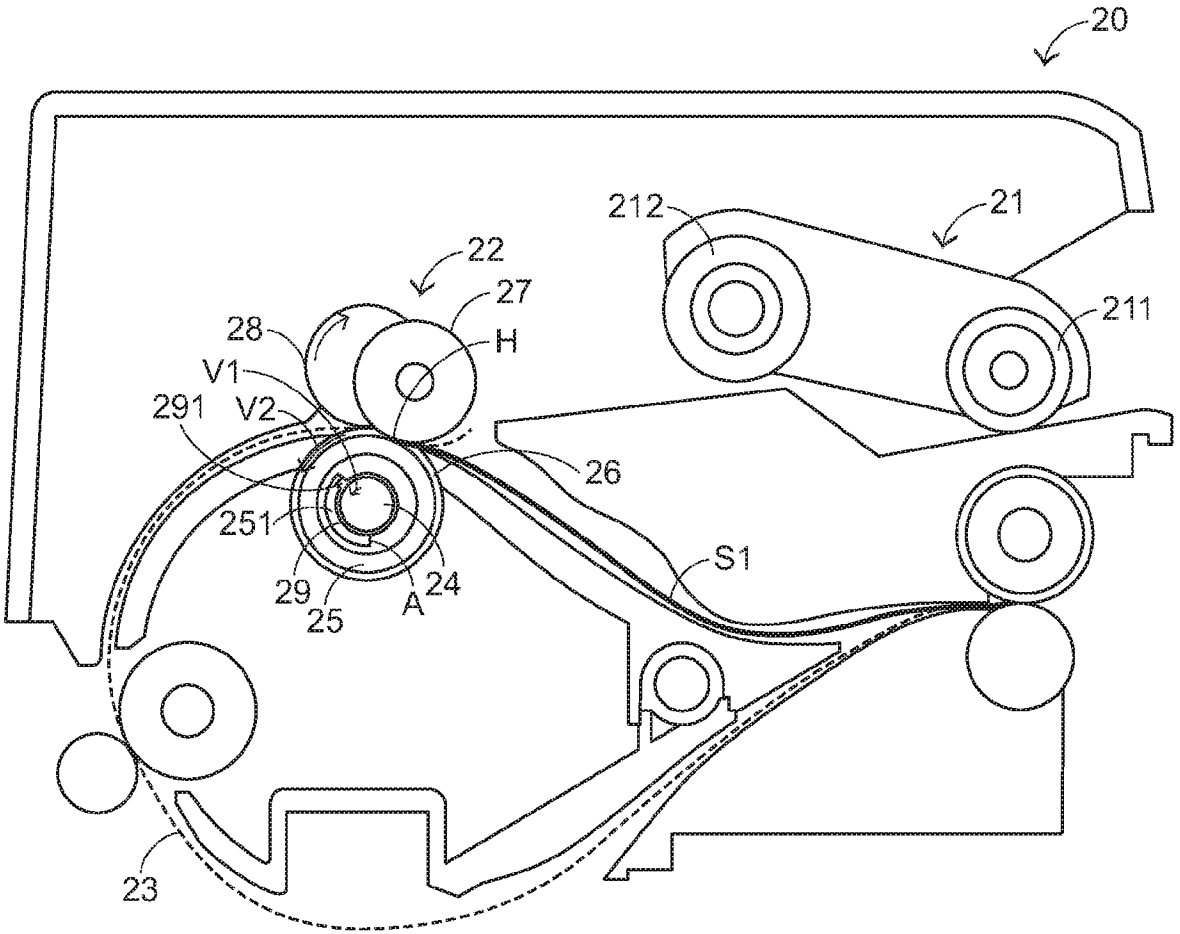

In a case that the a single-sided feeding operation is being performed by the automatic document feeder 20, a next paper S2 is hindered by the first roller 25 and the first idler 27 from being continuously advanced, so that the skew phenomenon of the next paper S2 can be corrected (see FIG. 9). Until the protrusion structure 291 is sustained against the first end A of the concave structure 251 again, the front edge G of the next paper S2 is allowed to pass through the first roller 25.

In a case that the a duplex feeding operation is being performed by the automatic document feeder 20, after the paper S1 is completely departed from the transfer roller assembly 22, the paper S1 will be transmitted through the duplex feeding channel 23 again. That is, the paper S1 is hindered by the first roller 25 and the first idler 27 from being continuously advanced, so that the skew phenomenon of the paper S1 can be corrected again. Until the protrusion structure 291 is sustained against the first end A of the concave structure 251 again (see FIG. 10), the front edge H of the paper S1 is allowed to pass through the first roller 25.

In a preferred embodiment, for facilitating the first roller 25 to quickly reach the static status, the first idler 27 further comprises an anti-slip cover 271 (see FIG. 3). As shown in FIG. 3, the anti-slip cover 271 is disposed on the surface of the first idler 27. After the paper is completely departed from the first roller 25, the first roller 25 is directly contacted with the anti-slip cover 271 of the first idler 27, so that a friction force is generated. Due to the friction force, the rotating speed of the first roller 25 is quickly lowered down, and the first roller 25 can quickly reach the static status.

From the above embodiments, the automatic document feeder of the present invention comprises a paper pick-up device, a transfer roller assembly, and a duplex feeding channel. The transfer roller assembly comprises a shaft, a first roller, a second roller, a first idler, a second idler, and a power-coupling device. The first roller is sheathed around the shaft. The second roller and the power-coupling device are disposed on the shaft. In addition, the power-coupling device is located at a side of the first roller.

When the power-coupling device is connected with the shaft and the first roller, the first roller is driven to be rotated at a third speed by the shaft, and the first idler is driven to be rotated by the first roller. Consequently, the first roller has the function of transmitting the paper. When the first roller is driven to be rotated at the second speed by the paper, the power connection between the first roller and the shaft is released by the power-coupling device. After the paper is completely departed from the first roller and during the power connection between the shaft and first roller is established again through the power-coupling device, the first roller and the first idler reach the static status. Consequently, the first roller and the first idler have the function of correcting the skewed paper.

From the above description, the present invention provides an automatic document feeder. Since the diameter of the first roller is different from the diameter of the second roller, the first roller and the second roller have a speed difference. Due to the speed difference between the first roller and the second roller and the arrangement of the power-coupling device, the power connection between the shaft and the first roller is selectively established or released. Consequently, without the need of changing the speed of the shaft, the first roller is still in the static status in the initial stage of feeding the paper in order to correct the skewed paper. In such design, the paper skew problem can be effectively solved. Moreover, the time period for accelerating the shaft from the static state to the normal speed can be saved. Consequently, the automatic document feeder of the present invention has enhanced paper-feeding efficiency and reduced operating time.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder, comprising:

a paper pick-up device for transmitting a paper into said automatic document feeder;

a shaft located downstream of said paper pick-up device, and rotated at a first speed;

a first roller sheathed around said shaft;

a second roller disposed on said shaft for transmitting said paper, wherein a diameter of said second roller is greater than a diameter of said first roller, wherein said second roller is driven to be rotated at a second speed by said shaft;

a first idler located upstream of said shaft for performing a skew correction on said paper, wherein said first idler is driven to be rotated by said first roller;

a second idler, wherein said second idler is just disposed over the second roller, wherein said second idler is driven to be rotated by said second roller; and a power-coupling device disposed on said shaft, and located at a side of said first roller, wherein when said power-coupling device is connected with said shaft and said first roller, said first roller is driven to be rotated at a third speed by said shaft, and said first idler is driven to be rotated by said first roller to start to transmit said paper, wherein when said paper is transmitted through said first roller and said second roller simultaneously, said first roller is driven to be rotated at said second speed by said paper, so that a power connection between said shaft and said first roller is released by said power-coupling device, wherein said second speed is higher than said third speed, wherein after said paper is completely departed from said first roller and during said power connection between said shaft and first roller is established by said power-coupling device again, said first roller and said first idler reach a static status.

2. The automatic document feeder according to claim 1, wherein said power-coupling device is a clutch spring.

3. The automatic document feeder according to claim 1, wherein said paper pick-up device comprises a pick-up roller and a separation roller.

4. The automatic document feeder according to claim 1, further comprising a duplex feeding channel for duplex feeding said paper, wherein said shaft is disposed in said duplex feeding channel.

5. The automatic document feeder according to claim 1, wherein said power-coupling device has a protrusion structure, and said first roller has a concave structure, wherein said protrusion structure is disposed in said concave structure.

6. An automatic document feeder, comprising:

a paper pick-up device for transmitting a paper into said automatic document feeder;

a shaft located downstream of said paper pick-up device, and rotated at a first speed;

a first roller sheathed around said shaft;

a second roller disposed on said shaft for transmitting said paper, wherein a diameter of said second roller is greater than a diameter of said first roller, wherein said second roller is driven to be rotated at a second speed by said shaft;

a first idler located upstream of said shaft for performing a skew correction on said paper, wherein said first idler is driven to be rotated by said first roller;

a duplex feeding channel for duplex feeding said paper, wherein said shaft is disposed in said duplex feeding channel; and a power-coupling device disposed on said shaft, and located at a side of said first roller, wherein when said power-coupling device is connected with said shaft and said first roller, said first roller is driven to be rotated at a third speed by said shaft, and said first idler is driven to be rotated by said first roller to start to transmit said paper, wherein when said paper is transmitted through said first roller and said second roller simultaneously, said first roller is driven to be rotated at said second speed by said paper, so that a power connection between said shaft and said first roller is released by said power-coupling device, wherein said second speed is higher than said third speed, wherein after said paper is completely departed from said first roller and during said power connection between said shaft and first roller is established by said power-coupling device again, said first roller and said first idler reach a static status.

7. The automatic document feeder according to claim 6, wherein said power-coupling device is a clutch spring.

8. The automatic document feeder according to claim 6, wherein said paper pick-up device comprises a pick-up roller and a separation roller.

9. The automatic document feeder according to claim 6, wherein said power-coupling device has a protrusion structure, and said first roller has a concave structure, wherein said protrusion structure is disposed in said concave structure.

* * * * *